US005405144A

United States Patent [19]

Ritchie et al.

[11] Patent Number: 5,405,144

[45] Date of Patent: Apr. 11, 1995

[54] TILTING PLAY FEATURE FOR A PINBALL GAME

[75] Inventors: Mark D. Ritchie, Carol Stream; John W. Skalon, DesPlaines, both of Ill.

[73] Assignee: Williams Electronics Games, Inc., Chicago, Ill.

[21] Appl. No.: 182,682

[22] Filed: Jan. 18, 1994

Related U.S. Application Data

[63] Continuation of Ser. No. 50,879, Apr. 21, 1993.

[51] Int. Cl.[6] ..... A63F 7/38

[52] U.S. Cl. ..... 273/121 A; 273/118 R; 273/119 R; 273/121 R; 273/127 R; 273/127 D

[58] Field of Search ..... 273/118–125, 273/127 R, 127 B, 127 D

[56] References Cited

U.S. PATENT DOCUMENTS

| | | | |
|---|---|---|---|
| 2,200,190 | 5/1940 | Plouvier | 273/121 A |
| 2,658,755 | 11/1953 | Benak | 273/121 A |
| 3,452,987 | 7/1969 | Di Motta | 273/121 A |
| 4,650,190 | 3/1987 | Geiger . | |
| 4,773,646 | 9/1988 | Joos, Jr. et al. | 273/121 A |
| 4,934,699 | 6/1990 | Kaminkow et al. | 273/121 A |
| 4,968,031 | 11/1990 | Kaminkow et al. | 273/121 A |
| 5,112,049 | 5/1992 | Borg | 273/119 AX |

OTHER PUBLICATIONS

Rat Race TM "tilt/top" maze game brochure.
Monte Carlo tilt/tip racing game brochure.

*Primary Examiner*—Vincent Millin
*Assistant Examiner*—Raleigh W. Chiu
*Attorney, Agent, or Firm*—Rockey, Rifkin and Ryther

[57] ABSTRACT

The play feature of the invention consists of an inclined ramp mounted for tilting motion along a single axis. A reversible electric motor, controlled by the flipper buttons, can pivot the ramp in either direction about the axis. The player, by manipulating the flipper buttons, controls the tilting of the ramp thereby to control the path of travel taken by the ball as it rolls down the ramp. The ramp is provided with a plurality of bumpers, roll over switches and out holes that allow the player to score points if the player traverses the ramp in the manner directed by the game program.

9 Claims, 3 Drawing Sheets

TILTING PLAY FEATURE FOR A PINBALL GAME

This is a continuation of copending application Ser. No. 08/050,879, filed on Apr. 21, 1993.

BACKGROUND OF THE INVENTION

The invention relates, generally, to pinball games and, more particularly, to an improved play feature for such games.

Pinball games typically consist of an inclined playfield supporting a plurality of play features such as ramps, targets, bumpers and the like. The game player manipulates flipper buttons mounted on the game cabinet to actuate flippers pivotably supported on the playfield to direct the ball at selected play features thereby to score points and control play of the game.

As will be apparent, the popularity of a manufacturer's line of pinball games will depend on its ability to attract players to its games. In order to attract players, it is necessary for game designers to continually develop new and interesting play features for the games.

Thus, a novel play feature for use in a pinball game is desired.

SUMMARY OF THE INVENTION

The play feature of the invention consists of an inclined ramp mounted for tilting motion along a single axis. A reversible electric motor, controlled by the flipper buttons, can pivot the ramp in either direction about the axis. The player, by manipulating the flipper buttons, controls the tilting of the ramp thereby to control the path of travel taken by the ball as it rolls down the ramp. The ramp is provided with a plurality of bumpers, roll over switches and out holes that allow the player to score points if the player traverses the ramp in the manner directed by the game program.

DETAILED DESCRIPTION OF THE INVENTION

Figure 1:
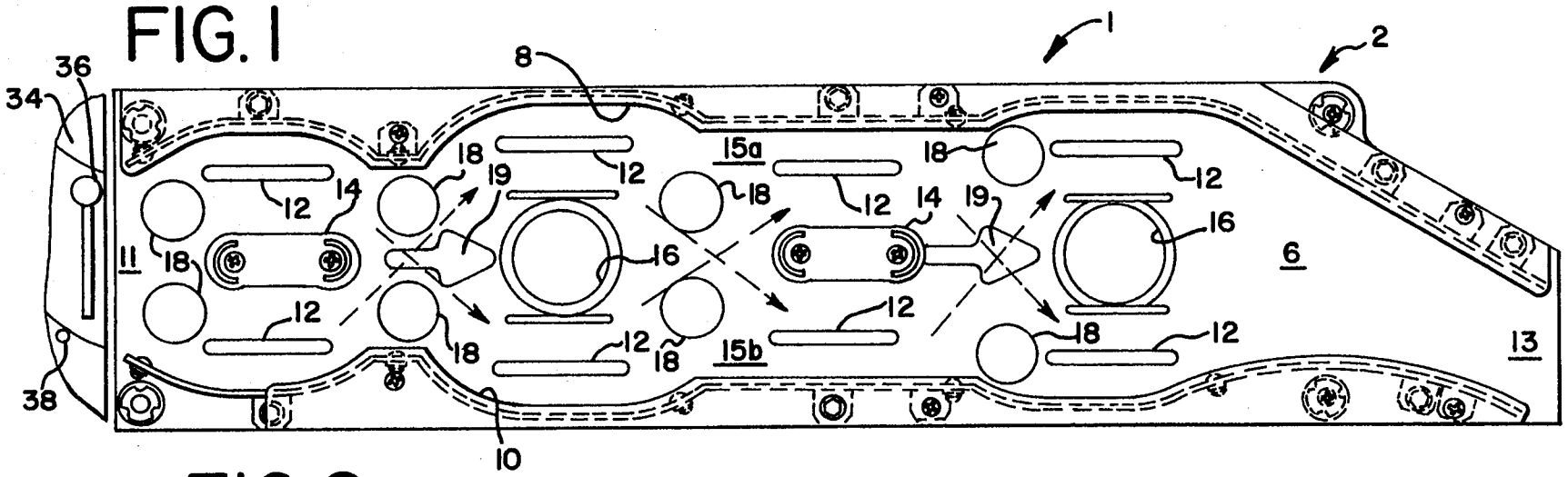
FIG. 1 is a top view of the tilting ramp of the invention.

Referring more particularly to the figures, the play feature of the invention is shown generally at 1 and consists of an inclined ramp 2 that, in the preferred embodiment, is mounted in an elevated position relative to playfield 4. Ramp 2 includes a surface 6 on which a ball can roll that is defined by side walls 8 and 10 and has an inlet end 11 and an outlet end 13. The surface 6 is provided with a plurality of roll over targets 12 that score points as is known in the art. The surface 6 further supports bumpers 14 and out holes 16 that generally divide the surface into a pair of adjacent pathways 15*a* and 15*b* such that the ball can move across the pathways between the bumpers and out holes as represented by dashed arrows in FIG. 1. It should be noted that the out holes and bumpers could have switches associated therewith to allow points to be scored when the ball contacts the bumpers or falls through an out hole.

The surface 6 further supports a plurality of lights 18 that in the preferred embodiment are arranged in front of each of the roll over targets 12 and lights 19 that are arranged in front of the out holes 16. The illumination of lights 18 and 19, in the preferred embodiment, is controlled by the game microprocessor such that the lights provide a visible signal to the game player as to which targets must be "hit" to achieve the desired game objective. In other words, the lights can be illuminated by the game microprocessor to define the desired path of travel of the ball.

Figure 2:
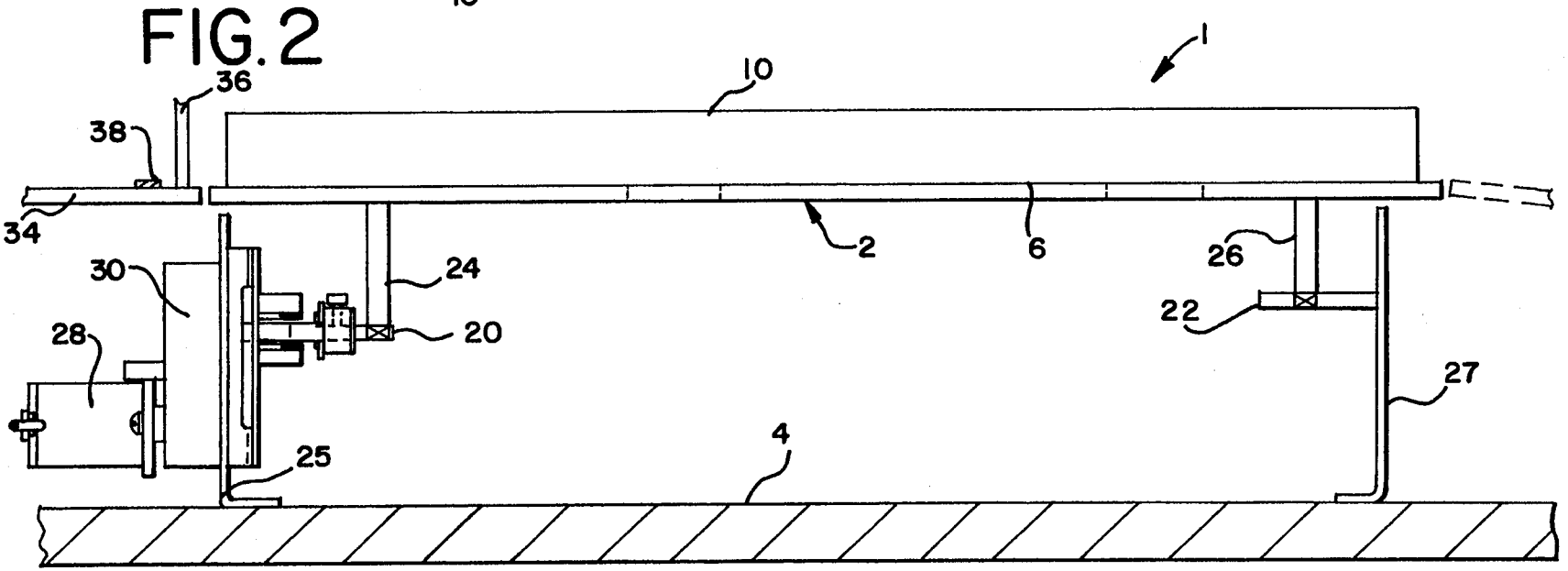
FIG. 2 is a side view of the play feature of the invention.
Figure 3:
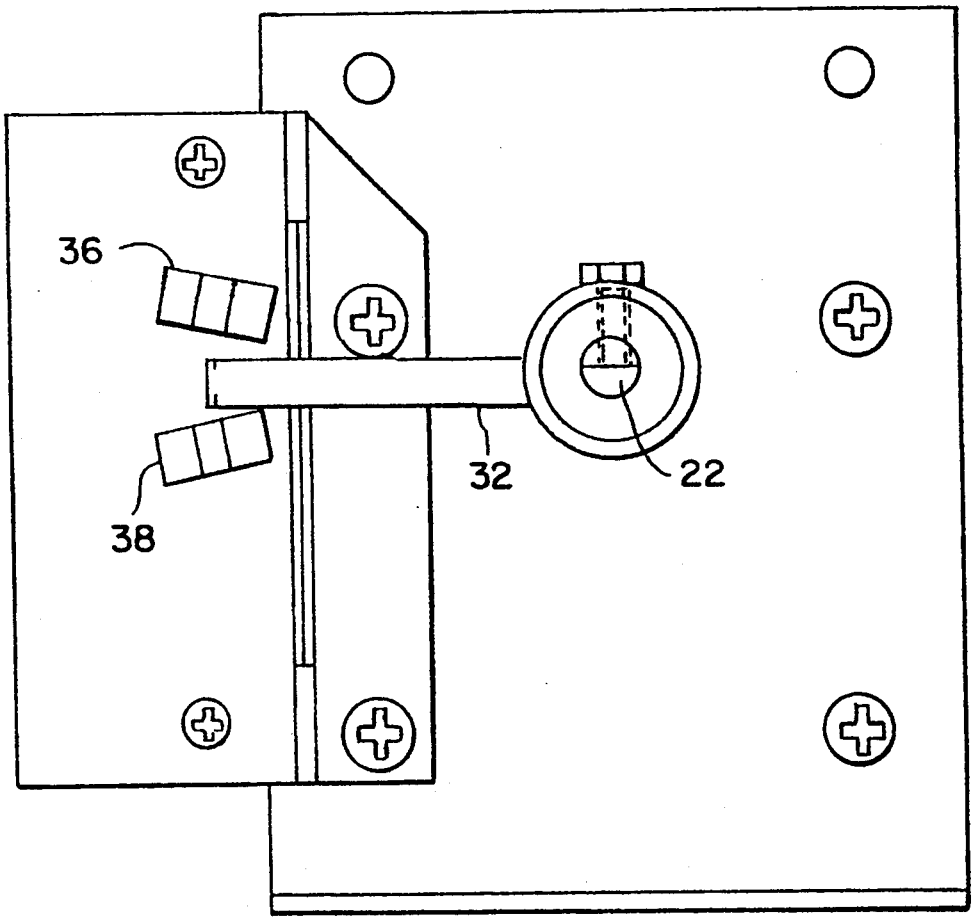
FIG. 3 is a view taken along line 3—3 of FIG. 2 showing the optical sensors for controlling the tilting of the ramp.
Figure 4:
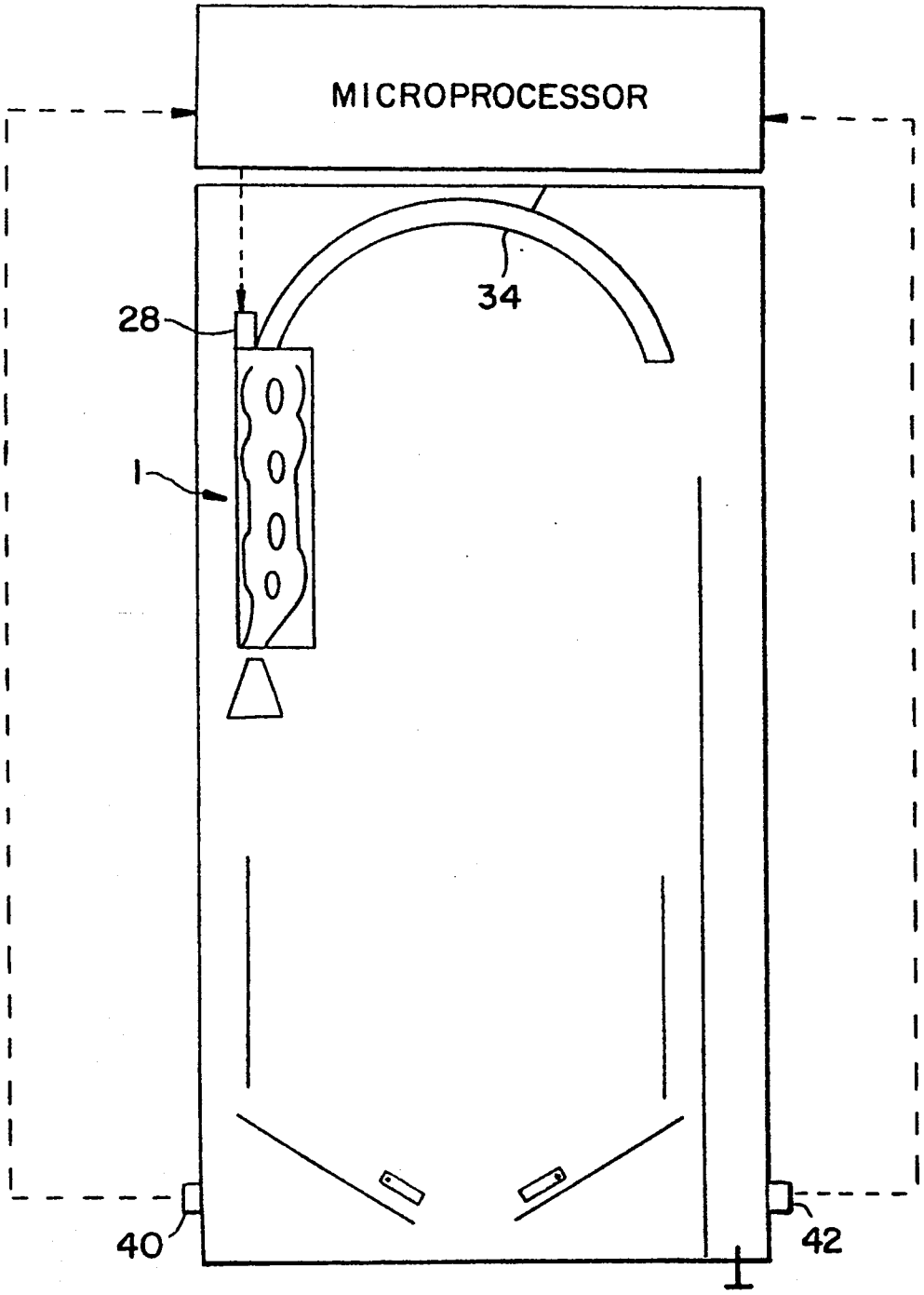
FIG. 4 shows the play feature of the invention mounted on a pinball game.

Referring to FIG. 2, the ramp 2 is supported on a pair of coaxially aligned pivots 20 and 22 fixed to the underside of surface 6 by brackets 24 and 26, respectively. The pivots 20 and 22 are supported on brackets 25 and 27, respectively, fixed to playfield 4. Reversible electric motor 28 is connected to pivot 20 by a suitable gear reducer 30. When motor 28 is energized, ramp 2 will be pivoted about the axis defined by pivots 20 and 22. In the preferred embodiment, the ramp is allowed to pivot a maximum of the ten degrees in either direction. To limit the pivoting of ramp 2, a pair of optical switches 36 and 38 are fixed to bracket 25 at positions that correspond to the ten degree limits and an opto-interrupter 32 is mounted on pivot 22 as best shown in FIG. 3. When opto-interrupter 32 opens either switch 36 or switch 38, motor 28 is deactivated to prevent further rotation of the ramp in that direction.

A ball can be delivered to the inlet end 11 of ramp 2 by any suitable mechanism. In the preferred form of the invention, a second ramp 34 is used to access ramp 2 where a gate 36 or other suitable mechanism allows a ball to enter the ramp only if the player achieves a predetermined game objective. A sensor 38 is located at the end of ramp 34 to provide a signal to the game microprocessor indicating that a ball is entering ramp 2.

Upon receipt of this signal, the game microprocessor, as directed by the software program, enables the player operated flipper buttons 40 and 42 to control the motor 28. Specifically, the left flipper button rotates the ramp in one direction (counter-clockwise) and the right flipper button rotates the ramp in the opposite direction (clockwise). The ramp is rotated a distance proportional to the time the flipper button is depressed. Thus, by properly controlling the flipper buttons, the ball on surface 6 can be made to traverse the ramp along a desired path as the ball rolls from the inlet end 11 to the outlet end 13.

In addition to enabling the flipper buttons, the microprocessor also energizes selected lights corresponding to the desired targets. The lights when illuminated define the desired path of travel for the ball. Finally, the microprocessor receives signals from the targets as the ball contacts each target to record the player's score.

While the invention has been described in some detail with reference to the figures, it will be appreciated that numerous changes in the details and construction of the device can be made without departing from the spirit and scope of the invention.

What is claimed is:

1. A play feature for a pinball game having an inclined playfield supporting a plurality of other play features and a rolling ball, comprising:

a) an inclined ramp having an inlet end and an outlet end for supporting a ball as it rolls from the inlet end to the outlet end;

b) means supporting said ramp for pivoting motion about an axis;

c) means for pivoting said ramp about said axis in two directions; and d) means operated by the player for controlling the means for pivoting thereby to control the path of travel of the ball as it rolls from the inlet end to the outlet end.

2. The play feature according to claim 1, wherein said ramp includes a plurality of targets.

3. The play feature according to claim 2, wherein said targets include roll over switches and out holes.

4. The play feature according to claim 1, wherein said means for pivoting includes a reversible electric motor.

5. The play feature according to claim 1, wherein said means operated by the player includes flipper buttons.

6. The play feature according to claim 1, further including means for defining a desired path of travel for said ball.

7. The play feature according to claim 6, wherein said means for defining includes a plurality of lights located on said ramp.

8. The play feature according to claim 1, further including means for delivering a ball to said inlet end.

9. The play feature according to claim 8, further including means for detecting the delivery of a ball to said inlet end.

* * * * *

UNITED STATES PATENT AND TRADEMARK OFFICE

CERTIFICATE OF CORRECTION

PATENT NO. : 5,405,144

DATED : April 11, 1995

INVENTOR(S) : Mark D. Ritchie, John W. Skalon, and Ronald G. Sommers

It is certified that error appears in the above-indentified patent and that said Letters Patent is hereby corrected as shown below:

On the title page item [75],

"Mark D. Ritchie, Carol Stream;
John W. Skalon, Des Plaines, both
of Ill."

Should read:

--Mark D. Ritchie, Carol Stream;
John W. Skalon, Des Plaines;
Ronald G. Sommers, Chicago,
all of Ill.--

Signed and Sealed this

Eighth Day of August, 1995

Bruce Lehman

*Attest:*

BRUCE LEHMAN

*Attesting Officer*

*Commissioner of Patents and Trademarks*